United States Patent [19]

Mori et al.

[11] 4,015,416

[45] Apr. 5, 1977

[54] METHOD AND DEVICE FOR CUTTING ROVE AT DOFFING IN FLYER FRAME

[75] Inventors: Mitsuo Mori, Toyota; Katsumi Nakane, Okazaki; Toshio Morishita, Kariya, all of Japan

[73] Assignee: Kabushiki Kaisha Toyoda Jidoshokki Seisakusho, Kariya, Japan

[22] Filed: Feb. 27, 1976

[21] Appl. No.: 662,085

[30] Foreign Application Priority Data

Mar. 5, 1975 Japan ..... 50-26912

[52] U.S. Cl. ..... 57/54; 57/52; 57/67; 57/156

[51] Int. Cl.[2] ..... D01H 1/24; D01H 1/26; D01H 9/16

[58] Field of Search ..... 57/34 R, 34 TT, 52, 57/54, 67, 70, 71, 82, 79, 78, 83, 86, 96, 117, 156

[56] References Cited

UNITED STATES PATENTS

| | | | |
|---|---|---|---|
| 2,701,946 | 2/1955 | Bridges et al. | 57/79 |
| 2,896,394 | 7/1959 | Johnson | 57/67 |
| 3,134,217 | 5/1964 | Williamson | 57/96 X |
| 3,174,270 | 3/1965 | Blaschke | 57/67 |
| 3,357,170 | 12/1967 | Pfeifer | 57/99 |
| 3,380,238 | 4/1968 | Araki et al. | 57/67 X |
| 3,681,905 | 8/1972 | Furtmeier et al. | 57/34 TT |
| 3,782,097 | 1/1974 | Nakamura et al. | 57/96 |

*Primary Examiner*—Donald Watkins
*Attorney, Agent, or Firm*—Wenderoth, Lind & Ponack

[57] ABSTRACT

A method and device are disclosed for cutting a rove at doffing in a flyer frame, wherein during the normal winding operation thereof the rove drawn out from front rollers is passed through the center hole of a flyer top, the hole of a hollow leg of a flyer, and over a presser and wound on a driven bobbin which is arranged on a bobbin rail moving up and down along the bobbin guide arbor of the flyer. Just before the doffing, the supply of the rove from the front rollers is failed and the bobbin and the flyer are caused to continue rotations substantially at the same speed for a time period sufficient to allow a predetermined number of rotations of both the bobbin and flyer, whereby the rove between the flyer top and the front rollers is subject to a stronger twist than that given during the normal winding operation. This assures that the rove is always cut of itself at an optimum portion thereof at the doffing.

11 Claims, 2 Drawing Figures

METHOD AND DEVICE FOR CUTTING ROVE AT DOFFING IN FLYER FRAME

BACKGROUND OF THE INVENTION

This invention relates generally to flyer frames, and more particularly to a method and device for cutting a rove at doffing in the flyer frame.

Generally, in a flyer frame and the like, at the time of the doffing of the bobbin therefrom, a rove connected to the full bobbin has to be cut somewhere. A cut position of the rove, at which it is cut, is preferably a portion away from the extremity of a flyer presser a suitable distance, as for example 50 to 60 mm, in view of a subsequent work, such as attaching of the cut end of the rove to an empty bobbin. However, in practice, the higher the strength of the rove is, the more it is made difficult to cause the rove to be cut at the above described position. The reason for this will be described hereinafter in conjunction with a flyer frame of the type including a suspended flyer. During the winding of the rove on the bobbin, the latter is rotated while moving up and down within predetermined ranges. After the winding is completed, the full bobbin thus produced is further lowered to a predetermined doffing position, which is usually out of the said predetermined ranges. At this time, a higher tension is produced in the rove than during the normal winding operation. However, the rove is positively held by the front rollers disposed adjacent to the flyer top and the rove meets with considerable resistances at the flyer neck and the flyer presser. Therefore, a highest tension is provided in a portion of the rove, which is near and out of the presser. In the case of the rove having a relatively weak strength, such as a cotton rove, the rove is cut at the desired position away from the presser extremity the distance of 50 to 60 mm only by the further lowering of the bobbin. However, in the case of the rove consisting of a relatively high strength of long fibers, such as a synthetic rove, the cutting is not effected at the desired position, but at a position between the front rollers and the flyer top, because this portion of the rove between the flyer top and the front rollers has a lowest strength due to a slight or unstable twist given thereto. This causes an operator inconvenience when carrying out the subsequent work as described hereinbefore. Thus, in the case of the synthetic rove, it has been practised to cut the rove at a position below the presser extremity by the hands of the operator before the further lowering of the bobbin rail to the predetermined position for the doffing. This not only requires additional time and labor for a number of spindles, but is an obstacle to an automatic doffing.

SUMMARY OF THE INVENTION

It is therefore the principal object of the invention to provide a method and device for cutting a rove, which eliminate the above described disadvantages of the prior art and enable the rove to be cut at the optimum position at the doffing.

It is another object of the invention to provide a method and device for cutting a rove at doffing, which always allow the automatic cutting of the rove at the optimum position with requiring no hands even in the case of a synthetic fiber rove having a relatively high strength.

This invention relates to a flyer frame comprising a plurality of rotary flyers, a plurality of rotary bobbin supporting members for supporting bobbins, on which roves are wound due to a speed difference between the associated flyers and bobbin supporting members, and means for driving both the flyers and bobbin supporting members with the speed difference, the driving means including a main driving shaft, through which the flyers, the bobbins and rove feeding rollers are driven, and means associated with the main driving shaft for providing the speed difference between the flyers and the bobbins. In one embodiment, the speed difference providing means comprises a change speed mechanism consisting of paired cone drums and a belt bridged therebetween, and a speed reduction mechanism consisting of a differential gear.

According to the method of this invention, just before the doffing, the supply of the rove from the front rollers is failed; however, both the bobbin and flyer are allowed to continue rotations substantially at the same speed for a relatively short time period sufficient to allow a predetermined number of rotations of both the flyer and bobbin, whereby the rove between the flyer top and the front rollers is subject to a stronger twist than that given during the normal winding operation. After the predetermined rotations of the bobbin and flyer, the bobbin is moved to provide the rove with a tension, which is stronger than that given during the normal winding operation. As a result, the rove is always cut of itself at an optimum portion thereof at the doffing.

According to the present invention, in order to allow both the flyer and bobbin to continue to rotate substantially at the same speed even after the stoppage of the rove feeding rollers, the driving means includes a coupling means or clutch so disposed therein that the rotation of the main driving shaft is transmitted through the clutch to the rove feeding rollers and the cone drums during the normal winding operation. Due to the presence of the clutch, when it is brought out of engagement just before the doffing, the feeding rollers are stopped to cease the supply of the rove and the cone drums are also stopped. However, the flyer continues to rotate and the bobbin is rotated through the differential gear associated with the main driving shaft. At this time, since rotation transmission paths of the driving means from the main driving shaft to the flyer and to the bobbin respectively are so designed that the bobbin and flyer are rotated substantially at the same speed, the rove winding on the bobbin is not effected and a twist is given to the rove at the portion between the flyer top and the rove feeding rollers.

BRIEF DESCRIPTION OF THE DRAWING

For better understanding of the invention, reference may be had to the preferred embodiment, exemplary of the invention, shown in the accompanying drawing, in which.

DESCRIPTION OF THE PREFERRED EMBODIMENT

Figure 1:
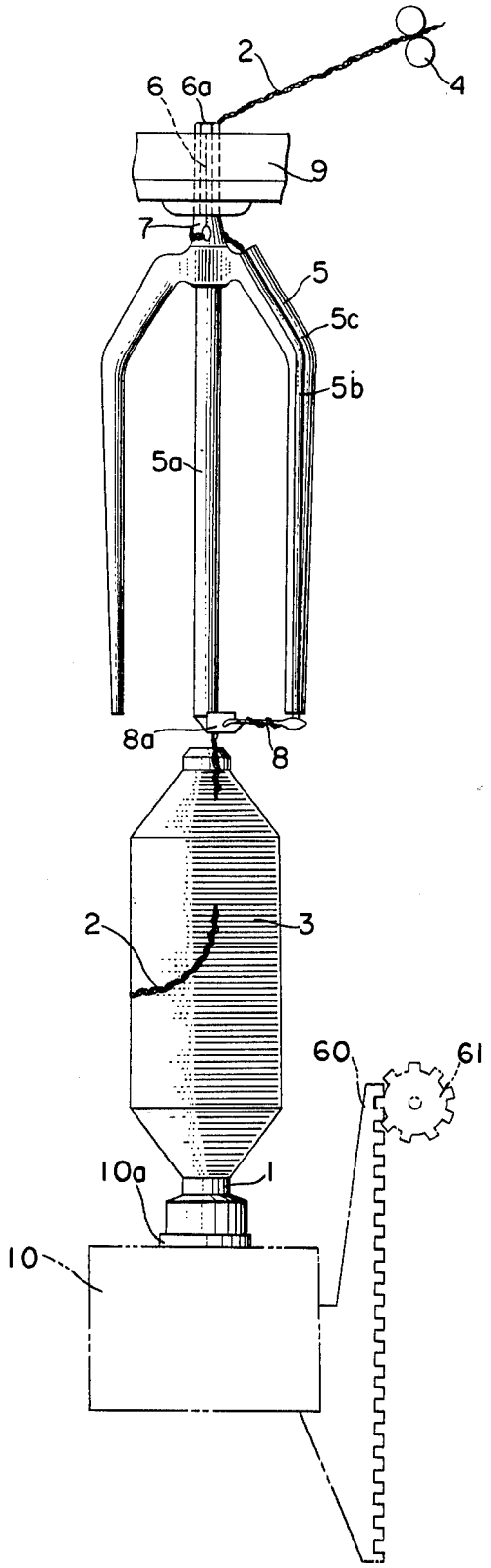
FIG. 1 is a fragmental elevational view showing a flyer frame in a rove cutting position, to which the invention is applicable.
Figure 2:
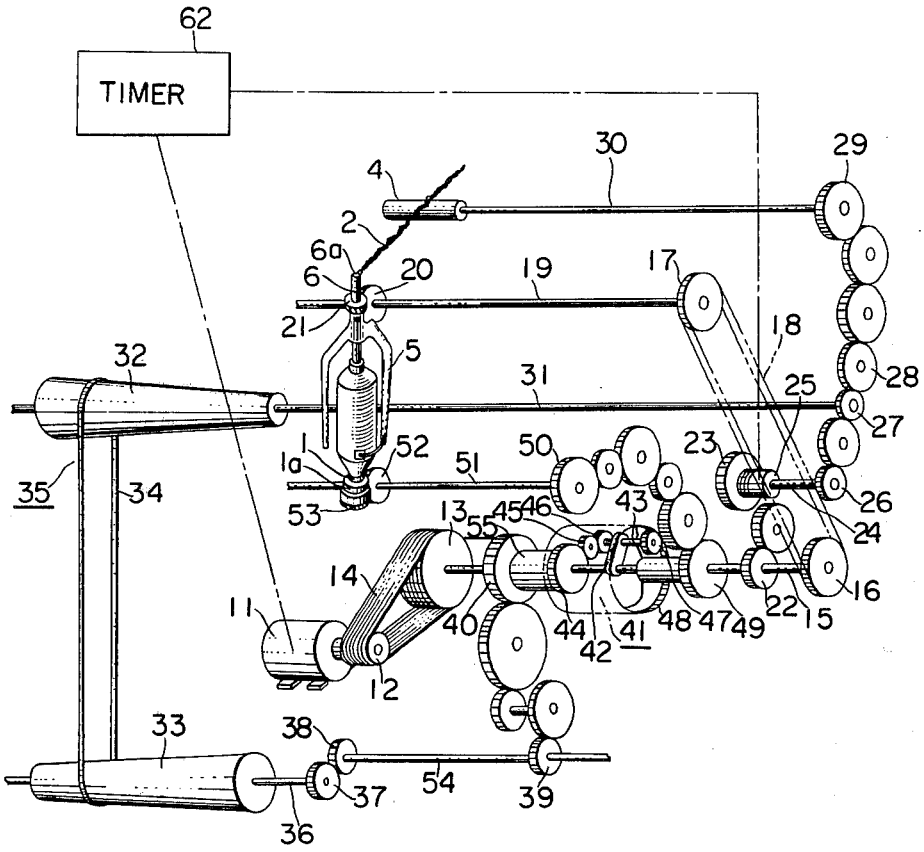
FIG. 2 is a perspective view showing a winding and driving means of the flyer frame incorporating with the invention.

Referring now to FIG. 1, as an example of one form in which the invention can be embodied, there is shown a flyer 5 having a rove guide tube 6, which is mounted and supported on an upper rail 9 for rotation through a suitable mechanism shown in FIG. 2. The flyer 5 is provided at its central portion with a bobbin guide arbor 5*a* which serves to guide and support a bobbin 1. A presser 8 is provided for guiding the rove 2 toward the bobbin 1 and its plate-shaped extremity 8*a* is adapted to press the rove 2 against the surface of the rove layer of the bobbin 1 slightly.

In a bobbin rail 10, there is a suitable mechanism, shown in FIG. 2, for driving the bobbin. The mechanism includes a bobbin drive shaft 1*a*, the upper end of which is provided with a short bobbin supporting member or plug having a flange 10*a* and projecting above the bobbin rail 10 as shown in FIG. 1. In the above manner, the bobbin 1 is guided and supported at its upper end by the bobbin guide arbor 5*a*, and at its lower end by the supporting member or plug mounted on the bobbin drive shaft 1*a*.

Such a flyer frame is diclosed in U.S. Pat. No. 3,380,238 issued Apr. 30, 1968 to H. Araki et al and assigned to the same assignee as the present application.

During the normal roving or winding operation of the flyer frame, the rove 2 drawn out from the front rove feeding rollers 4 is passed through the center hole 6*a* of the guide tube 6, the hole 5*b* of a hollow leg 5*c* of the flyer 5, and over the presser 8 and wound on the driven bobbin 1 which is arranged on the bobbin rail 10 moving up and down along the bobbin guide arbor 5*a* within the predetermined ranges. A mechanism for bobbin building motion of the bobbin rail 10 includes a rack 60 attached to the bobbin rail 10 and a pinion 61 engaging with the rack 60. The pinion 61 can be driven by a suitable mechanism, such as shown in FIG. 4 of the above U.S. Patent and therefore detailed descriptions thereof will be omitted. The vertical traverse motion of the bobbin rail 10 is maximum at the start of winding. When doffing the full bobbin, the bobbin rail 10 along with the bobbin is lowered to a position shown in FIG. 1, whereupon the rove 2 in the case of having a relatively low strength, such as a cotton rove, is cut at a desired position shown in FIG. 1 below about 50 to 60 mm from the presser extremity 8*a*. However, as will be described hereinbefore, especially in the case of the rove of a relatively high strength, the cutting of the rove 2 will not be effected at the above-mentioned desired position, but done at an unfavourable position between the flyer top and the front rollers 4, because a portion of the rove 2 therebetween is physically most weak due to a slight or unstable twist given thereto during the winding operation.

It is therefore understood that a sufficient twist has to be given to that portion of the rove 2 in order to allow the rove 2 to be always cut at the desired position below about 50 to 60 mm from the presser extremity 8*a*.

In many flyer frames, the winding of the rove on the bobbin is carried out by means of a bobbin lead system. In this case, speed relationships can be expressed as $$VB = p + v$$

wherein $VB$ is a layer surface speed of the bobbin 1 and $p$ is a surface speed of the presser extremity 8*a* and $v$ is a rove feeding speed of the front rollers 4. If it is assumed that $v = o$, i.e., the rove feeding from the front rollers 4 is stopped when the winding is completed and just before the doffing of the bobbin begins, we get $$VB = p$$

In order to satisfy $VB = p$, it is necessary that the flyer 5 and the bobbin 1 are rotated at the same rotational frequency. If the driving of both the flyer 5 and the bobbin 1 is so done to rotate them as for example about 5 turns, a desired twist will be given to the rove 2 at the portion thereof between the flyer top 6*a* and the front rollers 4 without allowing the winding of the rove on the bobbin 1, because the rove 2 is held by and not fed from the front rollers 4. Such a desired twist strengthens enough the portion of the rove 2 between the flyer top and the front rollers 4, which portion has had a weakest strength among the portions of the rove between the bobbin 1 and the front rollers 4 during the normal winding operation. Therefore, when the bobbin rail 10 is lowered to its predetermined position (FIG. 1) for the bobbin doffing, the rove 2 is always cut at the most favorable portion thereof below about 50 to 60 mm from the presser extremity 8*a* by merely lowering the bobbin rail 10. Thus, at the doffing, the rove can be prevented from being cut at the portion before it enters the flyer 5, or at other unfavorable portion.

Where the winding of the rove is carried out by means of a flyer lead system, speed relationships are apparently given by $VB = p - v$. Therefore, the above discussion is also applicable to the flyer lead flyer frame.

It is understood that, according to the rove cutting method of the present invention, just before the doffing, the operation of the front rollers 4 is cut off and at the same time both the flyer and the bobbin are rotated substantially at the same rotational frequency for a time, which is very short, but sufficient to give the above-mentioned desired twist to the weakest portion of the rove between the flyer top and the front rollers. The time for which the flyer and the bobbin are to be driven substantially at the same rotational frequency is preferably on the order of about 1 to 2 seconds that both the flyer and the bobbin are allowed to make about five turns. However, this number of turns may change with the kinds of the rove and other factors. Then, the bobbin rail 10 is lowered to its doffing position in the conventional manner, whereupon the strongest tension is produced in the portion of the rove immediately after the presser extremity, resulting in the cutting of the rove thereat. The length of the portion of the rove, to which the relatively strong twist is given just before the doffing, is so short that the subsequent operations will not be impeded by the twisted portion. However, if there is a fear that the twisted portion will interfere with the next winding thereof on an empty bobbin, the possible interference can be avoided by rotating the flyer 5 inversely after the doffing so that the additional twist, given to the portion of the rove between the flyer top and the front rollers just before the doffing, is released.

In addition, it is pointed out that the flyer and the bobbin are not required to be driven closely at the same rotational frequency and it is only necessary that they are driven in a speed relationship, which can give a suitable twist to the predetermined portion of the rove with allowing scarcely the taking-up of the rove on the bobbin. Furthermore, instead of lowering the bobbin rail after giving the desired twist to the rove, the bobbin rail and accordingly the bobbin may be raised to cut the rove at the portion thereof immediately after the presser extremity. From this, it is understood that the subsequent motion of the bobbin rail after giving the desired twist is needed only to cause the cutting of the rove. However, when cutting the rove, the bobbin rail is preferably lowered to bring the full bobbin out of engagement with the bobbin guide arbor, because in this case the full bobbin can be removed from the bobbin guide arbor without necessitating an additional movement of the bobbin rail.

Regarding a device for carrying out the abovementioned cutting method of the present invention, a detailed description will be made hereinafter in conjunction with FIG. 2, wherein a necessary driving mechanism for the flyer frame is shown.

The mechanism includes a source of power or an electric motor 11, a rotation of which is transmitted through V-belts 14 bridged between pulleys 12 and 13 to a main driving shaft 15. The flyer 5 is adapted to be rotated through a timing pulley 16 connected to one end of the driving shaft 15 remote from the pulley 13, a timing belt 18 shown by the dotted and dashed line, a timing pulley 17 operatively connected with the pulley 16 by the timing belt 18 and mounted on an intermediate shaft 19, and spiral gears 20 and 21 meshing together. The gear 20 is mounted on the intermediate shaft 19 and the gear 21 on the rove guide tube 6. One of the front rollers 4 is connected to a roller shaft 30 and accordingly rotated therewith from a spur gear 22 mounted on the main driving shaft 15 through a lower train of gears 22–23, an intermediate train of gears 26–27 and an upper train of gears 28–29. The lower and intermediate trains are connected together by an intermediate shaft 24 by having the gears 23 and 26 thereof mounted on the intermediate shaft 24 respectively. The gear 26 is fixedly mounted on the intermediate shaft 24. However, the gear 23 is loosely mounted on the intermediate shaft 24 and associated with a clutch means 25 disposed on the intermediate shaft 24 so that the rotation of the main driving shaft 15 can be selectively transmitted through the intermediate shaft 24, the intermediate and upper gear trains, etc. to the front rollers 4.

For the driving of the bobbin 1, a change speed mechanism 35 is provided consisting of a pair of cone drums 32 and 33 between which a suitable endless belt 34 is bridged for transverse movement along the axes of the drums to cause the speed difference therebetween. Descriptions of a mechanism for the transverse movement of the belt 34 will be omitted, because it may be of a conventional construction. The cone drum 32 is fixedly mounted on one end of an intermediate shaft 31, on the other end of which the gear 27 of the intermediate gear train is secured in a conventional manner. The lower cone drum 33 is mounted on a shaft 36 provided with a gear 37 meshing with a gear 38, which is in turn mounted on another shaft 54. The rotation of the shaft 54 is transmitted therefrom through a train of gears 39–40 to a composite gear assembly 55, which is loosely mounted on the main driving shaft 15 on one side of a differential gear 41 near the pulley 13, the differential gear 41 being in association with the main driving shaft 15. The differential gear 41 includes an arm 42 fixed at one end onto the main driving shaft 15, and planet gears 46 and 47 mounted on the opposite ends of an intermediate shaft 43 passing through the other end of the arm 42. The planet gear 46 is in meshing engagement with an intermediate gear 45 which in turn meshes with the inside gear 44 of the composite gear assembly 55. The inside gear 44 acts as a sun gear. Although not shown, the intermediate gear 45 is pivotably mounted on a part of the arm 42. The planet gear 47 is in meshing engagement with an internal gear 48 loosely mounted on the main driving shaft 15 on the other side of the differential gear 41. The internal gear 48 is combined with a gear 49 so that the rotation thereof is transmitted through a train of gears 49–50 to an intermediate shaft 51 and hence through spiral gears 52 and 53 to the bobbin 1. The gears 50 and 52 are mounted on the intermediate shaft 51 and the gear 53 is mounted on the bobbin driving shaft 1*a*, which is in driving engagement with the bobbin in a not shown, but conventional manner. Both the above-mentioned change speed mechanism 35 comprising the cone drums 32 and 33 and the above-mentioned reduction gear consisting of the differential gear 41 are of well known constructions and further detailed descriptions thereof will be omitted.

According to the present invention, the afore-mentioned driving mechanism including the change speed mechanism 35 and the differential gear 41 is characterized by the provision of the afore-mentioned clutch means 25 disposed in the rotation transmitting system for transmitting the rotation of the main driving shaft 15 to both the front rollers 4 and the change speed mechanism 35 to selectively allow the interruption and transmission of the main driving shaft rotation. The differential gear 41 and the train of gears 49–50 are so designed that when the clutch 25 is out of engagement the speed of revolution of the bobbin 1, which continues to rotate, is substantially the same as that of the flyer 5.

In operation, during the normal winding, the clutch 25 is in engagement and therefore the front rollers 4 are rotated at the constant speed through the lower, intermediate and upper trains of gears 22–29, etc. by the main driving shaft and the flyer 5 is rotated through the timing belt 18, etc. by the main driving shaft 15. The bobbin 1 is rotated at the momently changing speed corresponding to the diameter of the rove carried bobbin 1 through the main driving shaft 15, the lower and intermediate trains of gears 22–27, the shaft 31, the cone drum change speed mechanism 35, the shaft 36, the gears 37–40, the differential gear 41, the train of gears 49–50, the shaft 51, and the spiral gears 52 and 53. The number of revolutions of the train of gears 49–50 is under the influence of both the change speed function of the cone drum change speed mechanism 35, and the speed reduction function of the differential gear 41 exhibited by the combination of the sun gear 44 making the rotation in variable speed due to the change speed function of the cone drums, the planet gears 46 and 47 moved around the sun gear 44 from the main driving shaft 15 through the arm 42, and the internal gear 48. When the rove 2 drawn out from the front rollers 4 is fully wound on the bobbin 1, thus providing the full bobbin, the magnetic clutch 25 is brought out of engagement. Therefore, the rotation of the main driving shaft 15 is not transmitted to the intermediate shaft 24, resulting in the stoppage of the rotation of the shaft 24 followed by the stoppage of the rove feeding by the front rollers 4. Also, the cone drum change speed mechanism 35 is stopped and the rotation of the sun gear 44 is discontinued. At this time, both the bobbin 1 and the flyer 5 yet continue to rotate substantially at the same speed as described hereinbefore. That is, the said expression $VB = p$ is satisfied and the further winding of the rove 2 is not carried out, allowing the rove 2 to be twisted additionally at the portion thereof between the front rollers 4 and the flyer top and thus increasing the strength of the twisted rove portion. The twisting time, for which the bobbin is rotated substantially at the same speed as the flyer, may be very short and the motor 11 is set up by using a suitable timer 62 (FIG. 2) so that it is stopped immediately after the lapse of such a twisting time, thereby causing the simultaneous stopping of the bobbin 1 and the flyer 5. Then, the bobbin rail 10 is further lowered to the predetermined position, whereupon the relatively strong tension is provided in the rove 2 and the latter is cut of itself at the weakest portion thereof, which is positioned at the optimum distance of about 50 to 60 mm from the presser extremity 8*a*. For the twisting time, a time allowing about five simultaneous rotations of the bobbin and flyer is satisfactory. However, the invention is not limited thereto.

It is pointed out that the further lowering of the bobbin rail 10 may be effected before the stopping of the bobbin 1 and the flyer 5, if a sufficient twist has been given to the portion of the rove between the flyer top and the front rollers until the lowering of the bobbin rail.

While the invention has been illustrated and described with reference to a single preferred embodiment thereof, it is to be understood that various changes in the details of constructions and the arrangement and combination of parts may be made without departing from the spirit and scope of the invention. For example, the relative movement between the flyer and the bobbin to cut the rove at the desired position can be caused by rotating either the bobbin or the flyer or both of them at different speeds.

What we claim is:

1. In a method for cutting a rove at bobbin doffing in a flyer frame, of the type wherein the rove fed from rove feeding rollers is wound on the bobbin supported on a bobbin rail by means of a speed difference between the bobbin and a flyer with a presser, the improvement characterized by:

stopping the feeding of the rove from the rollers before the doffing;

giving a predetermined twist to a portion of the rove between the rollers and the flyer top; and imparting a relative motion between the flyer and the bobbin to thereby cut the rove at a portion thereof adjacent to and apart from the presser.

2. In a method according to claim 1, the improvement characterized by that the giving of the predetermined twist is effected by rotating the bobbin and the flyer substantially at the same speed.

3. In a method according to claim 2, the improvement characterized by that the relative motion is given after the rotation of both the bobbin and flyer at the same speed is stopped.

4. In a method according to claim 2, the improvement characterized by that the relative motion comprises a downward movement of the bobbin rail.

5. In a method according to claim 4, the improvement characterized by that the bobbin is placed into a doffing position thereof by the downward movement of the bobbin rail.

6. A flyer frame comprising a rotary flyer; a rotary bobbin on which a rove is wound due to a speed difference between the flyer and the bobbin; rove feeding rollers disposed near the flyer top; and an arrangement for driving the bobbin and the flyer with the speed difference and driving the rove feeding rollers, the driving arrangement including means for causing the rotation of the rove feeding rollers to be stopped, and means for causing the bobbin and flyer to rotate substantially at the same speed when the rotation of the rove feeding rollers is stopped.

7. A flyer frame according to claim 6, wherein the driving arrangement includes a main driving shaft for driving the bobbin, the flyer and the rove feeding rollers, a reduction gear associated with the main driving shaft and the bobbin to transmit the rotation of the main driving shaft to the bobbin with a speed reduction, and a change speed mechanism driven by the main driving shaft and driving the reduction gear, the means for causing the rotation of the rollers to be stopped being provided on a rotation transmission path of the driving arrangement from the main driving shaft to the rollers, the means for causing the substantially same speed rotation of the bobbin and flyer being provided on a rotation transmission path of the driving arrangement from the main driving shaft to the change speed mechanism.

8. A flyer frame according to claim 7, wherein both the rotation transmission paths overlap each other at a portion thereof, and the means for causing the rotation of the rollers to be stopped comprises a clutch, which is arranged in the overlapped portion of the rotation transmission paths so that it also acts as the means for causing the substantially same speed rotation of the bobbin and flyer.

9. In a flyer frame of the type including a rotary flyer, a rotary bobbin on which a rove is wound due to a speed difference between the flyer and the bobbin, a vertically movable bobbin rail supporting the bobbin, rove feeding rollers disposed near the flyer top, and means for driving the flyer frame, the driving means including a main driving shaft for driving the bobbin, the flyer and the rove feeding rollers, and a reduction gear consisting of a differential gear associated with the main driving shaft and the bobbin to transmit the rotation of the main driving shaft to the bobbin with a speed reduction, and a change speed mechanism consisting of a pair of cone drums having an endless belt arranged therearound, one of the cone drums being driven through the main driving shaft, the other of the cone drums driving the differential gear, the improvement characterized by:

means for selectively interrupting a transmission of the rotation of the driving shaft to the rove feeding rollers and the change speed mechanism, the interrupting means being disposed on the way of a rotation transmission path of the driving means from the main driving shaft to both the rove feeding rollers and the change speed mechanism; and the differential gear and a rotation transmission path of the driving means for transmission of the differential gear to the bobbin being designed so that the bobbin is rotated substantially at the same speed as the flyer when the interrupting means is in its rotation interrupting position.

10. In a flyer frame according to claim 9, the improvement characterized by that the interrupting means comprises a magnetic clutch, which is brought out of engagement before the doffing.

11. In a flyer frame according to claim 10, the improvement characterized by that the driving means comprises an electric motor connected to the main driving shaft, and a timer connected between the magnetic clutch and the motor so that, when the magnetic clutch is brought out of engagement, the motor is deenergized with a delay of a time, during which both the bobbin and the flyer are allowed to rotate substantially at the same speed.

* * * * *